United States Patent [19]

Yokomori

[11] Patent Number: 4,690,263

[45] Date of Patent: Sep. 1, 1987

[54] COIN REFUND SIGNAL GENERATOR

[75] Inventor: Shinji Yokomori, Kanagawa, Japan

[73] Assignee: Fuji Electric Co., Ltd., Japan

[21] Appl. No.: 885,732

[22] Filed: Jul. 21, 1986

Related U.S. Application Data

[63] Continuation of Ser. No. 549,724, Nov. 8, 1983, abandoned.

[51] Int. Cl.[4] ..... G07D 5/08

[52] U.S. Cl. ..... 194/317; 194/345

[58] Field of Search ..... 194/317, 318, 319, 345

[56] References Cited

U.S. PATENT DOCUMENTS 4,416,365 11/1983 Heiman ..... 194/317

4,432,447 2/1984 Tanaka ..... 194/100 A

*Primary Examiner*—F. J. Bartuska

*Attorney, Agent, or Firm*—Finnegan, Henderson, Farabow, Garrett & Dunner

[57] ABSTRACT

A coin refund signal generator includes a coin sorting sensing circuit which is normally in a quiescent state but which generates a sensing signal of a first duration in response to the deposit of a genuine coin and of a second duration in response to the actuation of a coin return requesting device. A detection circuit determines the duration of the sensing signal and generates a coin refund signal if the duration of the sensing signal equals or exceeds the second duration.

13 Claims, 9 Drawing Figures

FIG. 4
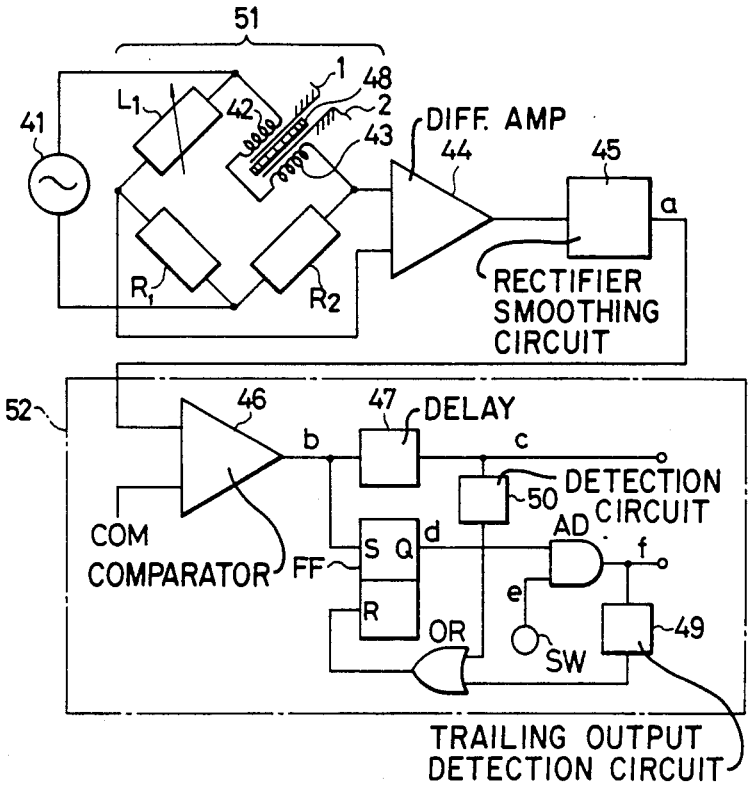
FIG. 5 (a)
FIG. 5 (b)
FIG. 5 (c)
FIG. 5 (d)
FIG. 5 (e)
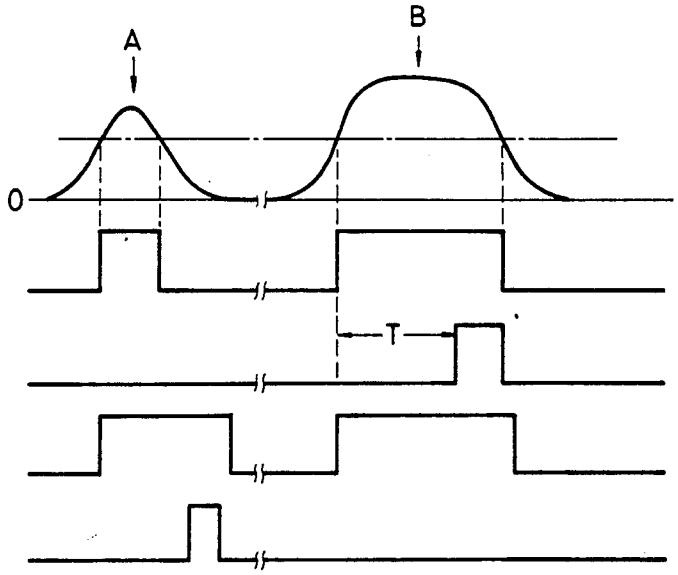

COIN REFUND SIGNAL GENERATOR

This application is a continuation of application Ser. No. 549,724, filed Nov. 8, 1983 now abandoned.

FIELD OF THE INVENTION

This invention relates to a coin refund signal generator for returning coins deposited in an automatic vending machine. In particular, the present invention utilizes the output of a coin sorting circuit to distinguish between the deposit of a coin and the operation of a coin return requesting means such as a refund lever.

BACKGROUND OF THE INVENTION

Automatic vending machines are normally arranged so that deposited coins can be returned by actuating refund levers attached to the machines. When a user cancels the purchase of goods, paper money, coins, and the like deposited into the machines are returned. If the user operates the refund lever, a device inside the machine generates a refund signal within a coin sorter mounted in the automatic vending machine. A money returning signal is generated responsive to the mechanical novement of the coin sorter by utilizing the mechanism of the coin sorter. Each time the refund lever is operated the coin passage is opened to permit the return of the coin interlockingly lodged therein and a coin return signal is generated.

FIG. 1 illustrates a coin sorter of this type, wherein the coin passage is caused to be opened. As shown in FIG. 1, the coin sorter includes a fixed side wall 1 fitted with a movable wall 2 which is rotatable in the direction of an arrow by means of a spring 3. The movable wall 2 is shut by being pressed against the fixed side wall 1 to form a coin passage with the fixed side wall 1. The fixed side wall 1 is equipped with a rolling contact passage 5 on which coins deposited from a slot 4 roll, a sorting coil 6 for inspecting the properties of the coins rolling on the rolling contact passage 6, and a gate 9 capable of appearing in and disappearing from the position where the coins are dropped. The gate 9 is withdrawn from the coin passage when a deposited coin is judged to be genuine by the sorting coil 6. When the gate 9 is withdrawn, the coin is directed to a coin passage for genuine coins. The gate 9 is caused to project into the coin passage when a deposited coin is judged to be counterfeit by the sorting coil 6. In this event, the coin is directed to a refund passage 8. A refund lever 11 is made of metal and is rotatably supported by a pin 10 which acts as a shaft. A detection coil 12 is provided to detect movement of the refund lever 11. A roller 13 is fixed to the refund lever 11 and a projection 14 having a tilted surface is provided on the movable wall 2 in the direction opposite to the roller 13.

If the refund lever attached to the front surface of an automatic vending machine (not shown) is operated to separate the movable wall 2 from the fixed side wall 1, the refund lever will rotate clockwise around the pin 10. When the refund lever 11 is turned clockwise, the roller 13 runs on the tilted surface of the projection 14 on the movable wall 2 and thus the movable wall 2 separates from the fixed side wall 1, causing the coin passage to be opened. As above described, the clockwise rotation of the refund lever 11 makes part of the refund lever 11 enter the sensitive region of the detection coil 12 and this causes the output voltage of the detection coil 12 to change sharply to generate a refund signal characterized as a change of the output voltage. In a conventional coin sorter thus constructed, the problem is that there is a large number of parts becuase the detection coil 12 must be provided solely to generate the refund signal responsive to the turning of the refund lever 11.

A device intended to solve this problem is identified in the Japanese Official Patent Gazette No. 159288, 1980 under the title of "A Coin Sorter." FIGS. 2 and 3 are schematic diagrams of this device.

In FIG. 2, like reference characters designate like or similar parts in FIG. 1. Form example, there is shown a fixed side wall 1 and a movable side wall 2. The fixed side wall 1 and the movable side wall 2 are respectively equipped with opposiing coin sorting sensors 21, 21 corresponding to the sorting coil 6 in FIG. 1. In the coin sorting sensors 21, 21, two coils 22, 23 are connected in series. The coils 22, 23 are further connected to a capacitor 24 in parallel and, together with the capacitor 24 are connected to an oscillation circuit 25.

The oscillation circuit 25, when in standby state, is constructed to produce oscillations with resonant frequencies determined by the coils 22, 23 and the capacitor 24. If a genuine coin 26 passes between the coin sorting sensors 21, 21, the self-inductance of the coils 22, 23 will change, causing the oscillating frequency of the oscillation circuit 25 to change. In addition, since the spacing between the coin sorting sensors 21, 21 becomes awider if the movable wall 2 is separated form the fixed side wall by revolution of the refund lever 11 shown in FIG. 1, the mutual inductance of the coils 22, 23 will change, also causing the oscillating frequency of the oscillation circuit 25 to change. Accordingly, the changed oscillating frequency of the oscillation circuit 25 when the movable wall 2 is opened is stored as a second reference value in this device.

In this manner, a genuine coin signal and a refund signal can be obtained by distinguishing between a genuine coin being deposited and the refund lever being operated. This determination is made based upon whether the oscillating frequency of the oscillation circuit 25 conforms to the first or second reference value.

According to this device, two reference values must be set up, though the detection coil shown in FIG. 1 can be deleted. There is a disadvantage, however, because the coin sorters must be assembled and manufactured under strict quality control to prevent dimensional errors that affect the inductance of the coils 21. It is difficult to make the dimcnsions equal between both the walls 1, 2, when the movable wall 2 is shut against the fixed side wall 1 and exactly locating the coin sorting sensors 21, 21 for all coin sorters. The dimensions between the walls and the assembly conditions of the coin sorting sensors differ depending upon the individual coin sorter and, as a result, the aforementioned magnitudes of the first and second reference values also change depending on the individual coin sorter.

For this reason, the forst and second reference values for each coin sorter must be measured by depositing a genuine coin and operating the refund lever, respectively, in order to set values in a memory based upon the measured results. Accordingly, as the number of reference values increases, more time will be required to set the reference values. This in turn causes the device to be unnecessarily costly and difficult to adjust.

OBJECTS AND SUMMARY OF THE INVENTION

It is an object of the present invention to generate a coin refund signal based upon the duration of a signal indicating a change in inductance between two coils in a coin sorter.

Another object of the present invention is a coin refund signal generator which is of simple construction and is tolerant of variations in assembly tolerances.

Still another object of the present invention is a coin refund signal generator which distinguishes between the mere insertion of a genuine coin and the operation of a coin return device based upon the duration of signal generated in response to each event.

A further object of this invention is a coin refund signal generator that has a minimal number of moving parts.

These and other objects are accomplished by a coin refund signal generator for use with a vending machine having a coin deposit opening, a coin processing path connected to the coin deposit opening, and a coin return requesting means, the refund signal generator comprising coin sorting sensing means in the coin processing path for generating a sensing signal having a first value or a second value, the signal being generated with the second value responsive to the deposit of a coin in the coin deposit opening and to the operation of the coin return requesting means, and detection circuit means for generating the coin refund signal responsive to the sensing signal having the second value for longer then a predetermined time period.

In a tore specific manner, the objects mentioned above can be attained according to the present invention by a coin refund signal generator of a coin sorter having a fixed side wall fitted with a movable wall which is freely opened and closed and a refund lever rotatably attached to the fixed side wall to form a coin passage between the fixed side wall and the movable wall. The movable wall is arranged to be separable from the fixed side wall by moving the refund lever. The coin refund signal generator comprises a coin sorting sensor comprising a first coil arranged on the fixed side wall to form an electromagnetic field and a second coil or a piece of magnetic material arranged on the movable wall opposite to the first coil, both the coils being connected in series, a detection circuit for detecting variations of inductance of the coil sorting sensor, and a decision circuit for determining that a coin has been deposited when the time that the output of the detection circuit exceeds a predetermined reference value is less than a predetermined time and that the movable wall has separated from the fixed wall when the time required is more than the predetermined reference value.

BRIEF DESCRIPTION OF THE DRAWINGS

These and other objects, features, and advantages of the invention, as well as the invention itself, will become more apparent to those skilled in the art in the light of the following detailed description taken in consideration with the accompanying drawings wherein:

FIG. 4 is circuit diagram of a preferred embodiment of the coin refund signal generator of the present invention; and FIGS. 5*a*–5*e* are a timing diagram for the operation of the circuit illustrated in FIG. 4.

DETAILED DESCRIPTION

Figure 1:
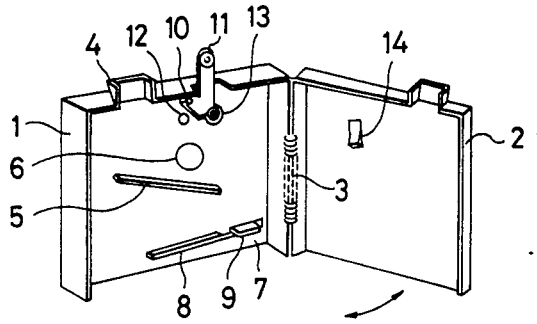
FIG. 1 PRIOR ART
FIGS. 1–3 are illustrations of prior art coin return mechanisms.
Figure 2:
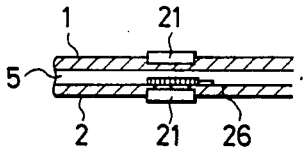
FIG. 2 PRIOR ART
Figure 3:
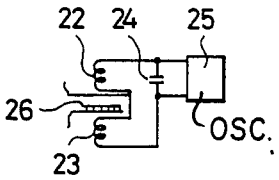
FIG. 3 PRIOR ART

In FIG. 4, there is shown a coin refund signal generator for use with a vending machine having a coin deposit opening, a coin processing path connected to the coin deposit opening, and a coin return requesting means. The refund signal generator comprises a coin sorting sensing means in said coin processing path for henerating a sensing signal having a first value or a second value, the signal being generated with the second value responsive to the deposit of a coin in the coin deposit opening and to the operation of the coin return requesting means.

As embodied herein, the coin sorting sensing means comprises a power supply 41, fixed resistors Rl, R2, a variable inductance element L1, coils 42, 43, a differential amplifier 44, and a rectifier smoothing circuit 45. The coils 42, 43 are adapted to be attached to the fixed side wall 1 and the movable wall 2 and are connected in series. The coils 42, 43, the fixed resistors R1, R2 and the variable inductance element L1 constitute a bridge circuit.

The output of the bridge circuit is supplied to the differential amplifier 44 and the output of the differential amplifier 44 is provided through the rectifier smoothing circuit 45 to detection circuit means for generating the coin refund signal responsive to the sensing signal having the second value for longer than a predetermined time period.

As embodied herein, the detection circuit comprises a comparator 46, an on-delay type timer 47, a flip flop FF, an OR gate OR, an AND gate AD, a trailing output detection circuit 49, and a detection circuit 50.

The output of the comparator 46 is connected with the on-delay type timer 47 and at the same time with the setting input of the flip flop FF. The output of the timer 47 is connected with one of the inputs of the OR circuit OR. The normal output, Q, of the flip flop FF is connected with one of the inputs of the AND element AD. A coin detection switch SW is connected to the other input of the AND element AD.

The coin detection switch SW is installed on the genuine coin passage 8 lower than the gate 9 as shown in FIG. 1 and is used to confirm that a genuine coin has been received by the genuine coin passage 8. The coin detection switch SW generates a genuine coin signal for counting coins. Such a coin detection switch SW is well known, for example, the device which appears in the Japanese Official Patent Gazette No. 30877, 1972 (under the title of "Coin Sorter").

The output of the AND circuit AD is connected with the other input of the OR circuit OR through the trailing output detection circuit 49 composed of differential elements, whereas the output of the OR circuit OR is connected with the reset input of the flip flop FF.

The bridge circuit is so regulated by the variable impedance element Ll that the circuit is balanced in a standby state, i.e., when no coin has been deposited and the movable wall 2 has been shut against the fixed side wall 1. When in the standby state the bridge circuit generates the sensing signal having the first value.

The bridge circuit is also arranged as a detection circuit 51 for detecting a change of the impedance of the coin sorting sensor to an unbalanced state as a result of changes in the impedance of the coils 42, 43. The impedance changes occur when a coin is deposited into the coin deposit opening and passes between the coils 52, 53 or when the movable wall 2 is separated from the fixed side wall 1 by the operation of the coin return requesting means, e.g., the refund lever. These events cause the bridge circuit to generate the sensing signal having the second state.

Moreover, the time limit of the timer 47 is set longer than the time required for the deposited coin to pass through the position between the coils 42, 53. The operation of the coin refund signal generator will be described with reference to the timing diagrams of FIG. 5.

Since the variable inductance L1 is regulated so that the bridge circuit is balanced in a standby state, the output voltage of the bridge circuit in the standby state is zero and the output of the rectifier smoothing circuit 45 is at zero potential as shown in FIG. 5(*a*).

If a genuine coin is deposited in the coin deposit opening and passes between the coils 42, 43, the self-inductance of the coils 42, 43 willchange and the bridge circuit will become unbalanced so that its output voltage is increased.

The output of the bridge circuit is amplified by the differential amplifier 44, before being rectified by the rectifier smoothing circuit 45. The portion indicated by the arrow A in FIG. 5(*a*) and showing the output waveform of the rectifier smoothing circuit 45 is the waveform in case a genuine coin has been deposited. The output a of the rectifier smoothing circuit 45 is compared with the reference value COM having a voltage level indicated by an alternate long and short dashed line in FIG. 5(*a*) by the comparator 46 in the decision means 52. The comparator 46 generates the output b of a logical signal (1) for a period of time during which the output a of the rectifier smoothing circuit 45 reaches the reference value COM and exceeds the reference value COM as shown in FIG. 5(*b*).

The output b of the comparator 46 is applied to the timer 47 and to the set input of the flip flop FF. When the output b of the comparator 46 rises from the logical signal (0) to the logical signal (1), the timer 47 begins operation and the flip flop FF is set as shown in FIG. 5(*d*). Since the time limit of the timer 47 is longer than the time during which the coin passes between the coils 42, 43, the output b of the comparator 46 changes from the logical signal (1) to the logical signal (0) before the time limit of the timer has elapsed, Consequently, the (1) input signal in the timer 47 ceases to exist and the timer 47 returns to the initial state with an output c maintained at the logical signal (0) as shown in FIG. 5(*c*).

The AND gate AD includes an input terminal which receives the output d of the flip flop FF which is set by the output b of the comparator 46 when the coin is detected by the coin detector SW. In other words, the AND gate AD receives the set output of the flip flop FF when the coin passes the position between the coils 42, 43 and establishes the condition of logical multiplication when the coin has reached the position of the coin detector SW.

As shown in FIG. 5(*e*), as the detection signal e is given by the coin detector SW, an output f having the same time value of the detection signal e shown in FIG. 5(*e*) is outputted by the AND gate AD. When the output f of the AND gate AD rises, a short pulse signal is generated by the trailing output detection circuit 49 and is applied to the reset input of the flip flop FF through the OR gate OR. This resets the flip flop FF to the standby state.

The operation of the coin refund signal generator as a result of the operation of the coin return requesting means will now be discussed, When the movable wall 3 is separated from the fixed side wall 1, the bridge circuit becomes unbalanced as a result of changes in mutual inductance. The output a obtained by rectifying the output of the bridge by the rectifier smoothing circuit 45 through the differential amplifier 44 is shown by arrow B in FIG. 5(*a*). The output a of the rectifier smoothing circuit 45 is compared with the reference value COM in the comparator 46. The output b, shown in FIG. 5(*b*), is outputted by the comparator 46 for a period of time during which the output a of the rectifier smoothing circuit 45 reaches the reference value and exceeds the reference value.

As is made clear by the portions specified by arrows A, B in FIGS. 5(*a*) and (*b*), the time during which the bridge circuit is kept unbalanced by the operation of the coin return requesting means, is longer than the time during which the bridge circuit is kept unbalanced as a result of a deposit of a coin. The reason for this is that the time required to make the coils 42, 43 produce an inductance change by separating the movable wall 2 from the fixed side wall through the manual operation of the refund lever is longer than the timer required for a deposited coin to make the coils 42, 43 produce an inductance change.

The output b of the comparator 46 is applied to the flip flop FF and to the timer 47 to start the time limit operation. As the timc limit operation of the timer 47 progresses, the output c is sent out of the timer 47 as shown in FIG. 5(*c*) upon the elapsing of the time limit period. The output c is used as a coin refund signal.

As the output b of the comparator 46 changes from the logical signal (1) to the logical signal (0), the output c of the timer 47 also changes from the logical signal (1) to the logical signal (0). When the detection circuit 50 detects the trailing edge of the output c of the timer 47, the detection circuit 50 sends out a short pulse signal, which is then applied to the reset input of the flip flop Ff through the OR circuit OR to cause the flip flop FF to be reset and to establish a standby state.

In the above described example, a coil sorting sensor including ciols 42, 43 arranged opposite each other on the fixed side wall 1 and the movable wall 2 has been described. However, in place of one of the coils 42, 43, a piece of magnetic material could be employed to accomplish the same effect.

As above described, according to the present device, the difference in the time that the inductance of a coil means is unbalanced as a result of manually operating a refund lever versus the time that the inductance of a coil means is unbalanced as a result of the depositing of a genuine coin is used to generate a coin refund signal. This preferred embodiment makes it possible to dctermine with an extremely simple construction whether a genuine coin has been deposited or whether a refund lever has been operated. Another advantage of the present invention is the ease by which a reference value can be established in comparison with the same operation in a conventional coin sorter. In part, the shortened time required for setting up the reference value results from the use of only one reference value for comparison with the output of the detection circuit.

While the salient features of the invention have been described with reference to the drawing, it should be understood that the embodiment is susceptible of modification without departing from the spirit and scope of the following claims.

What is claimed is:

1. A coin refund signal generator for use with a vending machine having a coin deposit opening, a coin processing path connected to the coin deposit opening, and a coin return requesting means, the refund signal generator comprising:

coin sorting sensing means in said coin processing path for generating a sensing signal having a first value or a second value, said sensing signal being generated with said second value in response to the deposit of a coin in the coin deposit opening and also in response to the operation of the coin return requesting means; and detection circuit means for generating a coin refund signal in response to said sensing signal having said second value for longer than a predetermined time period.

2. A coin refund signal generator according to claim 1 wherein said coin sorting sensing means comprises coil means having an induced electromagnetic field in response to a coin in the coin processing path and to the operation of the coin return requesting means.

3. A coin refund signal generator according to claim 2 wherein said coin sorting sensing means comprises:

a power supply;

a bridge circuit, said bridge circuit comprising a first coil located on one side of the coin path and a second coil located on the other side of the coin path opposite the first coil, said first coil and said second coil being connected in series;

a differential amplifier connected to the output of said bridge circuit; and a rectifier smoothing circuit connected to the output of said differential amplifier, the presence of a coin in said coin path and the operation of the coin return requesting means causing a variation in inductance in said first and second coils and resulting in said rectifier smoothing circuit outputting said signal with said second value.

4. A coin refund signal generator according to claim 3 wherein said bridge circuit further compriser:

first resistive means;

second resistive means; and variable inductance means.

5. A coin refund signal generator according to claim 3 wherein said detection circuit means comprises:

means for generating an excess signal if said sensing signal is greater than a threshold signal; and timing means for generating a valid coin signal in response to said excess signal continuing for a first time period and the coin return signal in response to said excess signal continuing for a second time period.

6. A coin refund signal generator according to claim 5 wherein said second time period exceeds said first time period.

7. A coin refund signal generator according to claim 5 wherein said generating means comprises a comparator amplifier.

8. A coin refund signal generator according to claim 5 wherein said timing means comprises:

a flip flop circuit set in response to said excess signal; and a delay circuit for outputting the coin return signal responsive to the continuous supply of said excess signal for longer than said second time period.

9. A coin refund signal generator according to claim 8 further including:

means for indicating the presence of a genuine coin in the coin path; and a coin acceptance signal generator for generating a signal indicating the acceptance of a genuine coin deposited in the coin deposit opening responsive to said set condition of said flip-flop and to said indication of the presence of a genuine coin in the coin path.

10. A coin refund signal generator for use with a vending machine having a coin deposit opening, a coin processing path connected to the coin deposit opening, and a coin return requesting means operable to request the return of a coin deposited in the coin deposit opening, the coin refund signal generator comprising:

circuit means operative to generate a coin refund signal in response to the application of an input signal for a predetemined time interval;

coil means operative when activated to provide said input signal, said coil means being activated in response to the presence of a coin in the coin processing path to provide said input signal for a time interval less than said predetermined time interval;

switch means activated in response to the presence of a coin leaving said coin processing path;

second circuit means operative from a first to a second state in responsc to said input signal for indicating the activation of said coil means, and responsive in the alternative to the activation of said switch means and the generation of said coin refund signal for changing from said second stat to said first state to indicate the passage of a coin leaving the coin processing path.

11. A coin refund generator according to claim 10, wherein said coil means comprises:

a first coil positioned on one sidc of the coil path;

a second coil connected in series with the first coil and positioned on the other side of said coin path opposite said first coil; and a differential amplifier for generating said input signal in response to a change in inductance between said first coil and said second coil caused by the presence of a coin in the coin path and in the alternative, the operation of thc coin return requesting means.

12. A coin refund signal generator according to claim 11, wherein said circuit means includes a timing means operative to generate the coin refund signal during the application of the input signal subsequent to the expiration of a predetermined time interval following the commencement of the application of the input signal.

13. In a coin refund signal generator including a fixed sidewall, a movable wall engageable with said fixed side wall, a coin passage formed when said fixed sidewall and said movable side wall are engaged, coin sorting coil means provided on said fixed and said movable walls for inspecting a property of a coin rolling in said coin passage, a gate for directing the coin to either a genuine coin passage or a return passage in response to a signal from said coin sorting coil means, a coin sensor for sensing a coin directed by said gate to the genuine coin passage, and a refund lever for disengaging said movable wall from said fixed wall, the combination of:

detection means for detecting a change in impednace of said coin sorting coil means in response to the disengagement of said movable wall from said fixed wall and in the alternative to a coin rolling in said coin passage;

comparison means for comparing said change of impedance said detection means to a predetermined value;

flip-flop circuit means normally in one state and operated to another state in response to said comparison from said comparison means;

timing means for timing the duration of the output of said comparison means, said timing means being operative to generate a coin refund signal in response to a predetermined time duration of the output of said comparison means to cause a refund of the coin and for operating said flip-flop means to said one state; and gate means for producing a genuine coin signal for counting a number of inserted coins passing through said coin passage for operating said flip-flop means to said one state in response to a coin sensing signal while said flip-flop means is in the other state.

* * * * *

UNITED STATES PATENT AND TRADEMARK OFFICE

CERTIFICATE OF CORRECTION

PATENT NO. : 4,690,263

DATED : September 1, 1987

INVENTOR(S) : Shinji Yokomori, et al.

It is certified that error appears in the above-identified patent and that said Letters Patent is hereby corrected as shown below:

In claim 10, column 8, Line 26, change:

"responsc" to --response--.

In claim 10, line 31, change:

"stat" to --state--.

In claim 13, line 64, change:

"impednace" to --impedance--.

Signed and Sealed this

Sixteenth Day of February, 1988

*Attest:*

*Attesting Officer*

DONALD J. QUIGG

*Commissioner of Patents and Trademarks*